US005409023A

United States Patent [19]

Santarossa et al.

[11] Patent Number: 5,409,023

[45] Date of Patent: Apr. 25, 1995

[54] DISHWASHING MACHINE WITH WATER FILL CONTROL

[76] Inventors: Gianni Santarossa, Via S. Agnese 9/A, 33080 Porcia, Pordenone; Claudio Milocco, Via Piero Gobetti 4, 33170 Pordenone, both of Italy

[21] Appl. No.: 136,961

[22] Filed: Oct. 14, 1993

[30] Foreign Application Priority Data

Oct. 20, 1992 [IT] Italy ..... PN92U079

[51] Int. Cl.[6] ..... B08B 3/02

[52] U.S. Cl. ..... 134/57 D; 134/56 D; 134/58 D

[58] Field of Search ..... 134/57 D, 56 D, 58 D; 68/12.23, 12.11, 12.17, 12.02

[56] References Cited

U.S. PATENT DOCUMENTS

| | | | |
|---|---|---|---|
| 3,334,651 | 8/1967 | Clearman | 134/57 D |
| 3,344,804 | 10/1967 | Lyman | 134/57 D |
| 3,358,701 | 12/1967 | Fay | 134/57 D |
| 3,519,796 | 7/1970 | Bebinger | 134/57 D |
| 3,835,880 | 9/1974 | Hoffman et al. | 134/57 D |
| 4,119,116 | 10/1978 | Johnson et al. | 134/57 D |
| 4,271,861 | 6/1981 | Crawford | 134/57 D |
| 5,257,171 | 10/1992 | Hara | 134/57 D |

FOREIGN PATENT DOCUMENTS

| | | | |
|---|---|---|---|
| 1207409 | 7/1986 | Canada | 134/56 D |

*Primary Examiner*—Frankie L. Stinson

[57] ABSTRACT

In order to complete a water fill phase, an electromagnetically actuated water fill valve (11) enables water from a supply source to flow into a dishwasher tank, this water being at the same time taken in by a circulation pump (3). Both the valve and the pump are controlled by a timer switch arranged to be energized from a power supply source (4, 5) through a normally open pressure-responsive switch (14) that is arranged to close when the pressure at the delivery side of said circulation pump (3) rises beyond a pre-determined value (P2). At the beginning of the water fill phase, the valve (11) is opened by the timer switch until the latter has been energized for a pre-determined total period of time (T) where T equals the summation of times T1–T6.

2 Claims, 1 Drawing Sheet

DISHWASHING MACHINE WITH WATER FILL CONTROL

BACKGROUND OF THE INVENTION

This invention relates in general to dishwashing machines, and more particularly to an automatic dishwashing machine provided with a simple, but effective means for controlling the amount of water provided to the washing tank of the machine.

As it is generally known, modern dishwashing machines, in order to save energy, must be capable of controlling as accurately as possible the amount of water in their washing tank. In particular, water should be minimized to the amount necessary to ensure a correct operation of the machine. Usually, this is achieved through an optimization of the water control circuitry of the dishwashing machine, and the use of sophisticated transducer devices and control arrangements to regulate the water fill process accordingly.

For instance, European patent application EP-A-0 118 719 discloses a water fill control system of the "dynamic" type, i.e. a control system that has a circulating pump switched on and, therefore, operating while fill water is being provided to the washing tub through an electromagnetically actuated water inlet valve. Electronic control means are used to detect the variations in a signal that is proportional to the delivery pressure of the pump, so that they can command or actuate the water inlet valve to switch off when the amplitude of said variations falls below a pre-determined value. This "dynamic" type water control system has proven to be particularly effective and accurate in its operation. However, it requires the use of complex and costly electronic components.

Much simpler water fill control systems are also known. "Overflow"-type and/or "air trap"-type water level control means, such as for instance arrangements of the type disclosed in European patent application EP-B-0 248 339. These simpler arrangements, however, have a common drawback in that soil particles present in the water circuitry or the dishwashing machine can easily interfere with the water level control means, thereby impairing their correct operation.

In view of achieving greater reliability, it has also been proposed to provide dishwashing machines with a simple water fill control system of the "dynamic" type, in which a pressure-actuated water level control switch is adapted to detect the delivery pressure of the circulating pump of the machine and to command or actuate the electromagnetic water inlet valve to be energized to open, when such a pressure is detected to have fallen below a pre-determined value. Such a solution is effective in minimizing the afore cited problems brought about by the dirt particles in the water circuitry of the machine, but may well prove to be inaccurate. As a matter of fact, under particular operation conditions of the dishwashing machine, e.g. when the wash water in the tank develops foam, the pressure detected by the pressure-actuated switch can decrease considerably, so that the electromagnetic water inlet valve can be unduly energized and, therefore, opened. This false opening of the water inlet valve means that during any phase of and even at any moment during single phases of the cycle of operation of the dishwashing machine, an excess amount of water can be let into the washing tank, with the undesirable effect of increasing the actual overall energy consumption of the machine by use of excess fill water that has been or has to be heated.

It therefore is a purpose of the present invention to provide a dishwashing machine provided with a fill water control system which not only is particularly simple and reliable, but also enables the machine to provide the lowest possible amount of fill water while still ensuring an optimum operation and performance.

SUMMARY OF THE INVENTION

According to the present invention, a dishwashing machine in provided with a water fill control system that minimizes the amount of wash and rinse water needed to thereby provide energy usage efficiency.

BRIEF DESCRIPTION OF THE DRAWINGS

The characteristics and the advantages of the present invention are further described below, by way of non-limiting example, with reference to the accompanying drawings in which.

DETAILED DESCRIPTION OF THE PREFERRED EMBODIMENT

The dishwashing machine according to the present invention is generally of a traditional type and is therefor not shown in detail. It essentially comprises a washing tank that houses at least a rotary spray arm assembly adapted to be supplied with water by means of a motor-driven circulating pump 3, as shown in FIG. 1.

Figure 1:
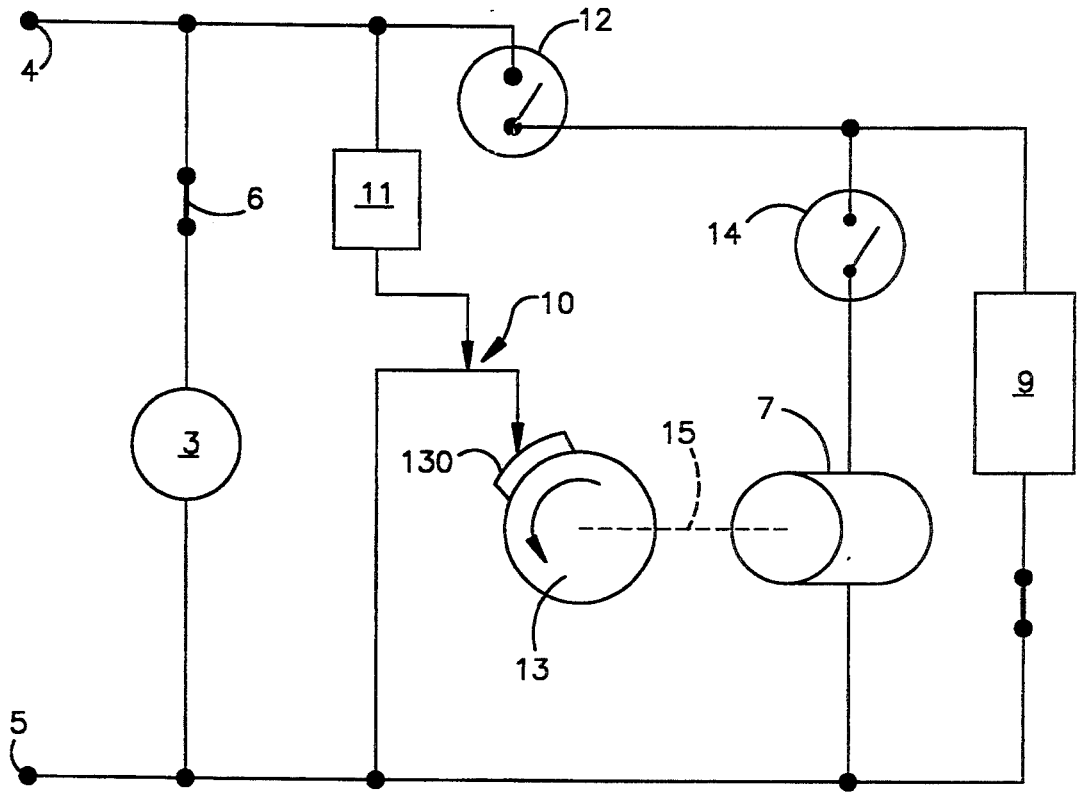
FIG. 1 is a schematic diagram outlining the connections of the main operational elements of the dishwashing machine in a preferred embodiment of the present invention.

It can be seen from FIG. 1 that the motor-driven circulating pump 3 is connected across the terminals 4, 5 of a power supply source through a switch 6 that is controlled by a timer device. The timer device may be of the electronic type, but preferably is of the electromechanical type, with an electric motor 7 having a rotating shaft 15 that drives a plurality of rotating cams 13 adapted to control respective switches so as to actuate a plurality of electric loads in a well-defined timed sequence.

In particular, in addition to switch 6, said timer device 7 is adapted to control a switch 8, which controls a resistance-type heating element 9, as well as a switch 10, which controls an electromagnetically actuated water fill valve 11.

In a preferred way, said resistance-type heating element 9 is connected across the terminals 4, 5 of the power supply in series with the switch 8 and a safety pressure-actuated water-level control switch 12 or similar device. In a per se known way, said pressure-actuated water-level control switch 12 is of the normally open type and is adapted to close when the water in the washing tank has reached a pre-determined minimum filling level so as to prevent the resistance-type heating element 9 from overheating; for instance, such a minimum filling level of the water in the tank corresponds to a pressure P1 (FIG. 2) at the delivery side of the circulating pump 3.

The switch 10, connecting the electromagnetic water fill valve 11 across the power supply source 4, 5, is of the normally open type and is controlled by a specially profiled cam 13 of the timer device. According to a feature of the present invention, in fact, said cam 13 is made so as to be adapted to close the switch 10, in correspondence of each one of the water fill phases called for by the operational program being performed by the dishwashing machine, for a period of time having a predetermined duration T (for instance, 15 sec.) in the case that the cam 13 is driven in advance in a continuous way by the timer device 7.

As shown in FIG. 1, by way of example, the period of time T associated with each water fill phase may be defined by a corresponding circular sector 130 of the cam 13 having a jutting profile as shown. In any case, the duration of said period T is generally calculated according to such design parameters of the dishwashing machine as overall size and capacity.

According to a further feature of the present invention, the timer device motor 7 is connected across the power supply source 4, 5 through a process pressure-acruated water-level control switch 14, which is preferably placed downstream of the afore cited safety pressure-acruated water-level control switch 12.

Figure 2:
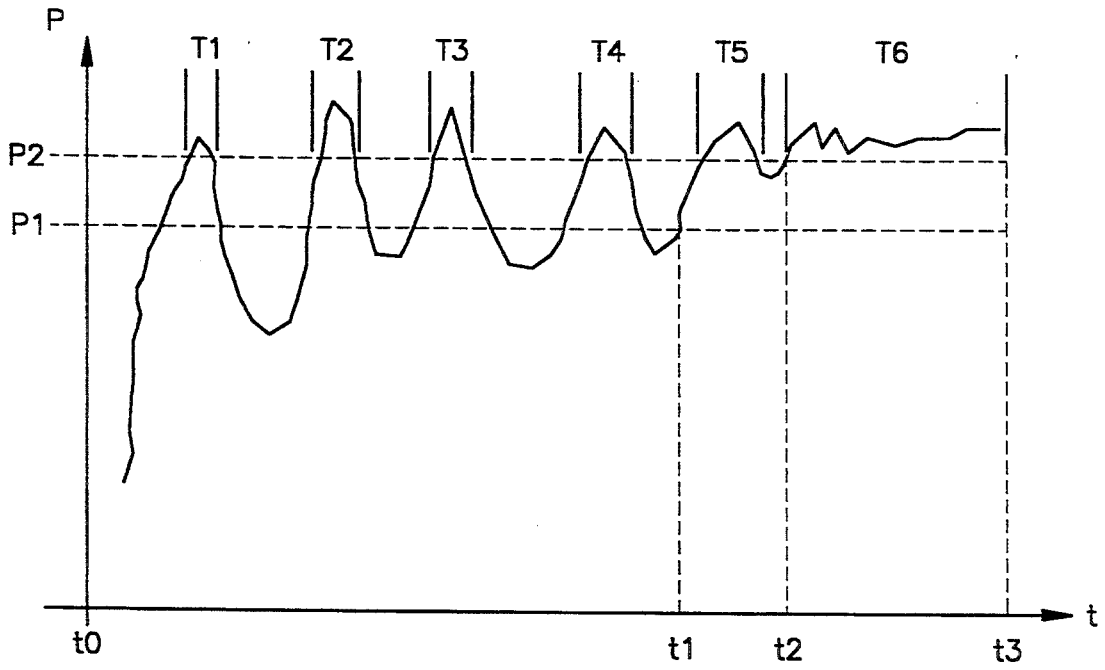
FIG. 2 is a schematic diagram showing the variations of the pressure at the delivery side of the circulating pump during a phase in which water is being filled into the washing tank of the dishwashing machine.

The process pressure-actuated water level control switch 14 is of the normally open type and is adapted to close when the pressure at the delivery side of the circulating pump 3 increases to exceed a pre-determined value P2>P1 (FIG. 2). Based on the overall sizing of the water circuit of the dishwashing machine, such a pressure P2 is calculated so as to correspond to an optimum priming condition for the circulating pump 3.

In practical operation, the timer device is set (for instance by manually rotating its shaft 15 into an appropriate angular position) so that the switches 6 and 10 controlled by it are initially closed to start, at a given moment t0, a water inlet phase to provide fill water to the washing tank of the dishwashing machine; in particular, the sector 130 of the cam 13 co-operates with the switch 10 so as to initiate the afore cited pre-determined period of time T. If the selected washing program includes also a water heating phase, the switch 8 is closed.

In a per se known way, therefore, for instance as disclosed in the afore cited European patent application EP-A-0 118 719, said water fill phase begins with the electromagnetic water-fill valve 11 being energized and opened and, at the same time, the circulating pump 3 being switched on and operated, while the pressure-actuated water-level control switches 12 and 14 are open. Accordingly, the timer device is therefore de-energized.

After a short initial period of time, during which the circulating pump 3 is not priming, the same pump starts priming in an irregular manner and the pressure P at its delivery side tends to increase with an attenuated oscillating pattern, as shown in FIG. 2.

In a per se known way, the pressure-actuated water-level control switch 12 closes, thereby enabling the resistance-type heating element 9 to start heating up the water, whenever the pressure P at the delivery side of the circulating pump 3 rises beyond the value P1, i.e. only when the same pressure-actuated water-level control switch 12 detects the presence of an adequate amount of water in the washing tank of the dishwashing machine. In particular, said resistance-type heating element 9 is energized in an intermittent way throughout a period of time up to the moment t1, after which the pressure P keeps constantly at a value that is higher than P1 and, as a consequence, the heating element 9 keeps being energized in a continuous way.

The water fill phase goes on with the electromagnetic water inlet valve 11 being kept open in a continuous way. The timer device motor 7 is kept de-energized until the pressure P at the delivery side of the circulating pump 3 rises to exceed the pre-determined value P2; each time that the process pressure-actuated water-level control switch 14 detects a pressure P>P2, it closes and , in this way, enables the timer device motor 7 to be energized. As it can be clearly seen in FIG. 2, up to a given moment t2 this condition occurs in an intermittent way during short time transients T1, T2, T3, T4, T5 (which will generally last less than 1 second), in correspondence of which the timer device 7 causes its cam 13 to progress, the sector 130 of said cam 13 being in any case capable of keeping the electromagnetic water inlet valve 11 in its open state.

Beyond said moment t2, the pressure P stays at a higher value than P2, since the circulating pump 3 has substantially reached its optimum priming condition. As a consequence, in the example described herein, the timer device motor 7, after said moment t2, is continuously energized, so that it causes the cam 13 to progress uninterruptedly, while the sector 130 of said cam 13 keeps the switch 10 in its closed state (and, therefore, the electromagnetic water inlet valve 11 in its open state) for a further transient T6. The latter comes to an end when, at a given moment t3, the sum of the transients T1, T2, T3, T4, T5 and T6, during which the timer device 7 is energized, is equal to the predetermined period of time T determined by the associated circular sector 130.

In other words, the water fill phase is carried out by having the electromagnetic water inlet valve 11 kept continuously open throughout a period of time t0–t3, during which the cam 13, and hence circular sector 130, is caused to progress intermittently during respective transients T1, T2, T3, T4, T5, T6 as determined by the actual priming conditions of the circulating pump 3.

As a consequence, the overall duration t0–t3 of the water fill phase will depend on the amount of water that is actually let into the washing tank of the dishwashing machine, regardless of possible variations in the water supply pressure.

Furthermore, through an appropriate overall sizing of the dishwashing machine, the water fill phase will only come to an end when, at the moment t3, the circulating pump will have positively and safely reached optimum priming conditions. As a matter of fact, as it can be clearly appreciated from the above description, during the transient T6 the circulating pump 3 reaches such priming conditions as to enable the cam 13 to complete its angular progression of rotation, as defined by the angular sector 30, that corresponds to the predetermined period of time T.

Of course, the particular working program selected for the dishwashing machine to perform will then be carried out in a traditional way, i.e. in a way that does not fall within the scope of the present invention and will therefore not be further described here.

The advantages of a dishwashing machine water fill technique according to the present invention are now fully apparent: only simple, easily manufactured mechanical and electromechanical component parts with a proven reliability record are in fact required to provide particularly accurate water fill phases that take into due account all main process parameters determining a good operation of the machine.

It will be appreciated that the above described dishwashing machine water fill control technique may be subject to any modification as considered to be appropriate without departing from the scope of the invention.

We claim:

1. In a dishwashing machine having a washing tank in which, during a water fill phase, a normally closed electromagnetically activated water fill valve (11) controlled by timing means is arranged to let in to the washing tank water from a water supply means, said water being at the same time drawn in by a circulating pump (3) that is controlled by said timing means and whose delivery supplies water to at least a rotary spray arm assembly, the improvement wherein said timing means comprises an electric motor (7) adapted to be energized from a power supply source (4, 5) through a normally open pressure-actuated switch (14) adapted to close when the pressure at the delivery side of the circulating pump (3) rises beyond a pre-determined value (P2), said electromagnetic valve (11) being arranged to be energized into its open state by said timing means at the beginning of said water fill phase, until said electric motor (7) has been energized for a predetermined total period of time (T).

2. A dishwashing machine according to claim 1, wherein said electromagnetic valve (11) is adapted to be energized from the power supply source through a switch controlled by a cam (13) that is driven by said electric motor, wherein said cam (13) includes a circular sector (130) which at the beginning of the water fill phase is adapted to be set at an angular position of rotation in which it causes said switch (10) to close until the electric motor (7) has been energized for said predetermined total period of time (T).

* * * * *

UNITED STATES PATENT AND TRADEMARK OFFICE

CERTIFICATE OF CORRECTION

PATENT NO. : 5,409,023

DATED : April 25, 1995

INVENTOR(S) : Santarossa et al.

BEST AVAILABLE COPY

It is certified that error appears in the above-indentified patent and that said Letters Patent is hereby corrected as shown below:

On the face of the patent, the following information should be inserted with respect to the assignee: --Zanussi Elettrodomestici S.p.A., Pordenone, Italy--.

On the face of the patent, the following information should be inserted with respect to the Attorney, Agent or Firm: -- Pearne, Gordon, McCoy & Granger--.

Column 3, line 20, delete "acruated" and insert --actuated--.

Column 3, line 22, delete "acruated" and insert --actuated--.

Column 4, line 54, delete "30" and insert --130--

Signed and Sealed this

Twenty-first Day of November, 1995

*Attest:*

Bruce Lehman

BRUCE LEHMAN

*Attesting Officer*

*Commissioner of Patents and Trademarks*